United States Patent [19]

McCreery

[11] 4,359,206

[45] Nov. 16, 1982

[54] SEVERE DUTY HYDRAULIC CYLINDER WITH CONTINUOUSLY EFFECTIVE LOCKING DEVICE

[76] Inventor: Robert B. McCreery, 542 N. Galloway St., Xenia, Ohio 45385

[21] Appl. No.: 188,231

[22] Filed: Sep. 19, 1980

[51] Int. Cl.[3] ..... B66F 3/24

[52] U.S. Cl. ..... 254/93 R; 92/17; 92/23; 92/51

[58] Field of Search ..... 92/17, 23, 51, 53; 254/93 R, 93 H, 93 HP

[56] References Cited

U.S. PATENT DOCUMENTS

| | | | |
|---|---|---|---|
| 2,408,181 | 9/1946 | Simonton | 92/23 |
| 2,961,837 | 11/1960 | Suderow | 92/51 |
| 3,083,592 | 4/1963 | Carlstedt | 92/17 |
| 3,321,182 | 5/1967 | Elenburg | 254/93 R |
| 3,664,636 | 5/1972 | Sherrill | 254/93 HP |
| 4,092,213 | 5/1978 | Nishimura | 92/17 |

FOREIGN PATENT DOCUMENTS

| | | | |
|---|---|---|---|
| 1206184 | 9/1970 | United Kingdom | 254/93 R |

*Primary Examiner*—Robert C. Watson
*Attorney, Agent, or Firm*—Harvey B. Jacboson

[57] ABSTRACT

A hydraulic cylinder comprising a hydraulically operated power lifting ram for lifting heavy loads further includes a guide cylinder concentric about and enclosing the ram, the guide cylinder being secured to the lift platform for further support of the load and reciprocating in unison with the ram under application of hydraulic pressure. The guide cylinder is equipped with a safety locking means which prevents the hydraulic cylinder and its load from lowering in the event of a sudden loss in hydraulic pressure. The safety locking means is in contact with the guide cylinder substantially during the full stroke of the hydraulic operated ram, providing a unique method of locking the cylinder in any position within tolerances normally associated with gear driven devices.

13 Claims, 7 Drawing Figures

SEVERE DUTY HYDRAULIC CYLINDER WITH CONTINUOUSLY EFFECTIVE LOCKING DEVICE

BACKGROUND OF THE INVENTION

Field of the Invention

This invention relates to hydraulic cylinders of the type in which a ram is hydraulically operated to raise and lower a particular load. In particular, the invention provides for a unique hydraulic cylinder in which the ram is enclosed within a guide cylinder which provides further support of the load and protects the ram of the hydraulic cylinder from extreme environmental conditions. The hydraulic cylinder of the present invention is provided with a unique safety locking means which can support the hydraulic cylinder and the load at any desired position and prevents the hydraulic cylinder and its load from lowering in the event of a sudden loss in hydraulic pressure.

One of the problems associated with hydraulic cylinders in which the hydraulic fluid activates a load lifting ram concerns instances in which the ram is large enough to act as a structural support column, in which instances the required safety factors against side loading necessitates the use of large diameter rams with resulting large volumes of hydraulic fluid at low operating pressures. Conventional small hydraulic cylinders exert large forces even though such cylinders are quite small. The large lifting force applied by these small hydraulic cylinders is possible simply by elevating the operating pressure. These cylinders must be externally supported against side loads and bending and are typically used on graders, dumpsters, back-hoes, etc., which operate normally in the 2,000 to 3,000 PSI range. Such relatively small hydraulic cylinders do not utilize the large volumes of hydraulic fluid required by a hydraulically operated ram also acting as a structural column to lift and support a load. The use of large volumes of hydraulic fluid to operate the load lifting ram is costly and creates unpredictable and non-uniform operation. For example, frequent applications require that the hydraulic cylinder be operated at a uniform speed during the raising and return stroke of the power lifting ram. If, for instance, it is necessary to remove the load after it has been raised, the pressure on the power lifting cylinder decreases drastically. The first requirement is to support the load during the raising operation, requiring large volumes of fluid pumped at a constant capacity and pressure. However, during the return stroke, the hydraulic pressure required is decreased causing difficulties in moving the large quantities of oil in and out of the cylinder to provide uniform movement. While pumps are available to supply fluid at the volumes and pressure required during the raising stroke, it is difficult to buy valves with the proper operating capability to permit the large quantity of fluid to flow from the cylinder at the decreased pressures when the lift is being lowered without the attached load. Consequently, the speed of the lift can be guaranteed during the working stroke, i.e., when the load is being raised, however, guaranteeing the speed on the down or return stroke without the attached load can be very difficult and subject to other problems. For instance, the viscosity of the hydraulic fluid has a tremendous bearing on the flow rate and when the hydraulic cylinder is operated under the low pressures, the viscosity of the fluid can cause serious problems in providing uniform raising and lowering of the ram.

Ordinarily, persons are not normally working under or around loads supported by small hydraulic cylinders, or at least in a position to be injured in case the loads slip and fall in the event of a sudden hydraulic pressure loss. In instances in which the ram also acts as a structural column, however, the rams are not ordinarily supported externally. Furthermore, the loads are not necessarily centered on the load platform or support means. Such a situation makes it necessary that primary consideration during the operation of the hydraulic cylinders be given to the structural strength or integrity of the ram, its guiding system and the connection between the ram and the load, and not so much as to the operating pressures. Accordingly, there is a constant fear present for any user of hydraulic equipment that there will be a failure of the valving, the cylinder itself or the hydraulic piping, to the extent that there will be an uncontrollable movement of the hydraulic cylinder. This fear is particularly felt in those areas where large and/or critical loads are being raised. For example, hydraulic elevators are susceptible to this type of problem as well as other types of equipment where people work directly under loads supported by hydraulic cylinders and/or situations where large and valuable pieces of equipment must be raised to variable heights and supported in that position for extended periods of time.

Also, there are instances in which the operating environment impairs the efficient and safe operation of the hydraulic cylinder. Extreme temperature, corrosive surroundings and atmospheres ladened with particulate matter can severely damage the power lifting ram causing work stoppages and hazardous operation.

Accordingly, there is a need for a hydraulic cylinder that will permit raising the load at a controllable pressure and will generate within the hydraulic system adequate pressure to move the hydraulic fluid through the valves at a controllable rate when the ram is being lowered. Further, a need exists for a heavy-duty hydraulic cylinder which will support the power lifting ram and attached loads at variable heights for extended periods of time, providing complete safety at all times regardless of the size of the load or its position throughout the ram stroke. A still further need involves the protection of the power lifting ram from severe conditions.

Disclosure Statement

Various kinds of hydraulic cylinders are used today, each one being designed to function in a specific environment. Some examples of hydraulic cylinders which include a ram situated in a guide cylinder of various construction and purpose are disclosed in U.S. Pat. Nos. 2,888,231, issued May 26, 1959, to Duncan; 2,961,837, issued Nov. 29, 1960, to Suderow; 2,965,375, issued Dec. 20, 1960, to Hamilton; 3,081,066, issued Mar. 12, 1963, to Murawski; 3,087,626, issued Apr. 30, 1963, to Kimball; 3,664,636, issued May 23, 1972, to Sherrill; and 3,782,689, issued Jan. 1, 1974, to Barosko. None of these patents, however, disclose hydraulic cylinders designed to alleviate the problems mentioned above, and there is no disclosure in any of the above patents for providing the safety locking means of the present invention, which is an advantageous feature unique to the present invention.

SUMMARY OF THE INVENTION

An object of the present invention is to provide a hydraulic cylinder of the type in which a hydraulically operated ram is utilized to raise and lower a load and in which the ram is of a size large enough to act as a structural column, in which the problems associated with such hydraulic cylinders such as those discussed above are solved.

Another object of the invention is to provide a hydraulic cylinder which can be operated at controllable hydraulic fluid pressures during both the raising and return stroke of the ram.

Another object of the invention is to provide a hydraulic cylinder in which the load lifting ram is not supported externally and is large enough to act as a structural column and in which the hydraulic cylinder can lift loads which are not centered in a safe and efficient manner.

Still another object of the present invention is to provide a hydraulic cylinder in which the ram of the cylinder is protected from severe conditions, such as extreme temperatures, corrosive elements and abrasive particulate material which may be present in the operating environment.

Still yet another object of the invention is to provide a hydraulic cylinder in which the cylinder and its attached load are prevented from falling during all portions of the ram stroke in the event of a sudden loss in hydraulic pressure.

These and other objects are achieved in accordance with the present invention by providing a ram of a size that will permit raising the load at a controllable pressure and which generates within the hydraulic system adequate pressure to allow the hydraulic fluid to pass through the valves at a controllable rate when the ram is being lowered. The ram is provided with a relatively small diameter and is mounted within a guide column or cylinder of adequate strength to support the forces generated by an eccentric load. Utilizing this type of an arrangement, the fluid required to raise the load is minimized in volume and at the same time elevated in pressure. State of the art power lifting rams are readily available for use and can very easily tolerate such higher pressures. Consequently, by utilizing the guide cylinder as an aid in supporting the load, relatively small pumps and valves are needed to supply fluid to the ram, requiring smaller fluid lines, reservoirs, etc.

Additionally, the guide cylinder provides protection to the inner cylinder or ram which allows the hydraulic cylinder of the present invention to be used in environments where such cylinders could not normally be used and operate safely and efficiently. In the past, scoring or marring of the rams from external sources has been of concern since the rams are also part of the hydraulic sealing mechanism. Typically, "V" type seals around the periphery of the ram have been applied in order to seal the hydraulic fluid and maintain the proper hydraulic pressure. Accordingly, if the exterior surface of the ram becomes worn or uneven, a leak will immediately occur. Such leaks typically get progressively worse necessitating replacement of the packing and servicing of the ram to remove the uneven portions. With the arrangement of the present invention, the sealed power lifting cylinder or ram is contained within the guide cylinder. The protection provided by the guide cylinder insures that the hydraulic power ram will last indefinitely since the ram is not subjected to the continual abuse typical of the environments in which such hydraulic cylinders are utilized.

Another advantage of the guide cylinder arrangement of the present invention results from the internal ram being protected against corrosion. In certain instances, hydraulic cylinders after being installed in the ground for periods of time, particularly in soils that contain an electrolyte or in soils that are subject to stray electrical currents, begin to corrode. In those instances wherein the external casing of the power lifting ram must contain the pressurized hydraulic fluid required to raise the load, a very hazardous situation exists. With the hydraulic cylinder of the present invention, corrosion of the power lifting ram and its disastrous results are eliminated since the ram is contained within its own separate protective casing, and, therefore is not subject to the corrosive environments.

Additionally, the guide cylinder used for supporting the load during lifting is prevented from undesired movement by including a guide mechanism placed between the exterior of the ram casing and the interior of the guide cylinder. The guide mechanism can be designed so as to prevent rotation of the guide cylinder during the upward movement thereof, or can be designed to provide controlled rotational movement. The guide mechanism includes steel bars welded to the exterior of the power ram casing which fit within a pair of guide shoes attached to the bottom of the guide cylinder. The guide bars can be straight along the vertical extent of the ram casing to prevent rotation or can be curved to provide controlled rotational movement of the guide cylinder.

As discussed earlier, to provide a system which would prevent the hydraulic cylinder and its load from falling in the event of a sudden loss in hydraulic pressure would be an advantageous safety feature. The exterior guide cylinder of the present invention enables such a safety system to be employed since it is now possible to raise a hydraulic cylinder and insert a lock pin, bar, or some other locking mechanism into the side wall of the guide cylinder without affecting the operation of the internal power lifting ram. Furthermore, additional devices attached to the guide cylinder could be used to actuate other operating mechanisms as the cylinder is raised. Preferably, in accordance with the invention, the safety system is provided by machining a helix or single groove around the exterior surface of the guide cylinder over a predetermined length thereof. A rotating locking nut including a thread to match the groove is placed around the guide cylinder and is capable of moving relative to the guide cylinder through a distance corresponding to the required travel of the hydraulic cylinder. The rotating locking nut is mounted on a heavy-duty anti-friction rotating bearing assembly which includes a plurality of gear teeth around the entire circumference thereof. The gear teeth on the exterior of the rotating bearing assembly are matched with a machined gear surface of a large drive gear. The inner surface of the rotating bearing assembly is attached rigidly to a suitable flange placed on the exterior of the guide cylinder casing and is preferably installed in a fixed position. The locking nut rotates in either direction based upon the direction of rotation of the rotating bearing assembly or is held from rotating by preventing the bearing assembly from rotating. The intermeshing drive gear rotates the bearing assembly and the locking nut in the controlled manner.

The matching thread on the locking nut contacted with the groove on the guide cylinder is so designed so as to provide ample capacity to withstand the various loads involved all within a factor of safety consistent with the loads being handled. As the hydraulic operated ram and the guide cylinder are being raised, a motor rotates the drive gear and associated bearing assembly and attached locking nut in such a way that the matching thread of the locking nut is in alignment with and coordinated with the movement of the helical groove on the guide cylinder. During operation, the locking nut is rotated at a potential speed slightly in excess of that required to match the vertical speed of the hydraulic cylinder, enabling the hydraulic cylinder to lift its attached load. The rotating locking nut is in constant contact with the formed groove in the guide cylinder and is placed in a supportive position thereon without actually providing enough power to raise the load. The inserted locking nut acts as a support to prevent the ram and guide cylinder from falling with the load in the event of a sudden loss of hydraulic pressure. The locking nut is in a locking position during the total raising and return stroke of the hydraulically operated ram and can lock the hydraulic cylinder in any position within tolerances normally associated with gear driven devices.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 4, 5:
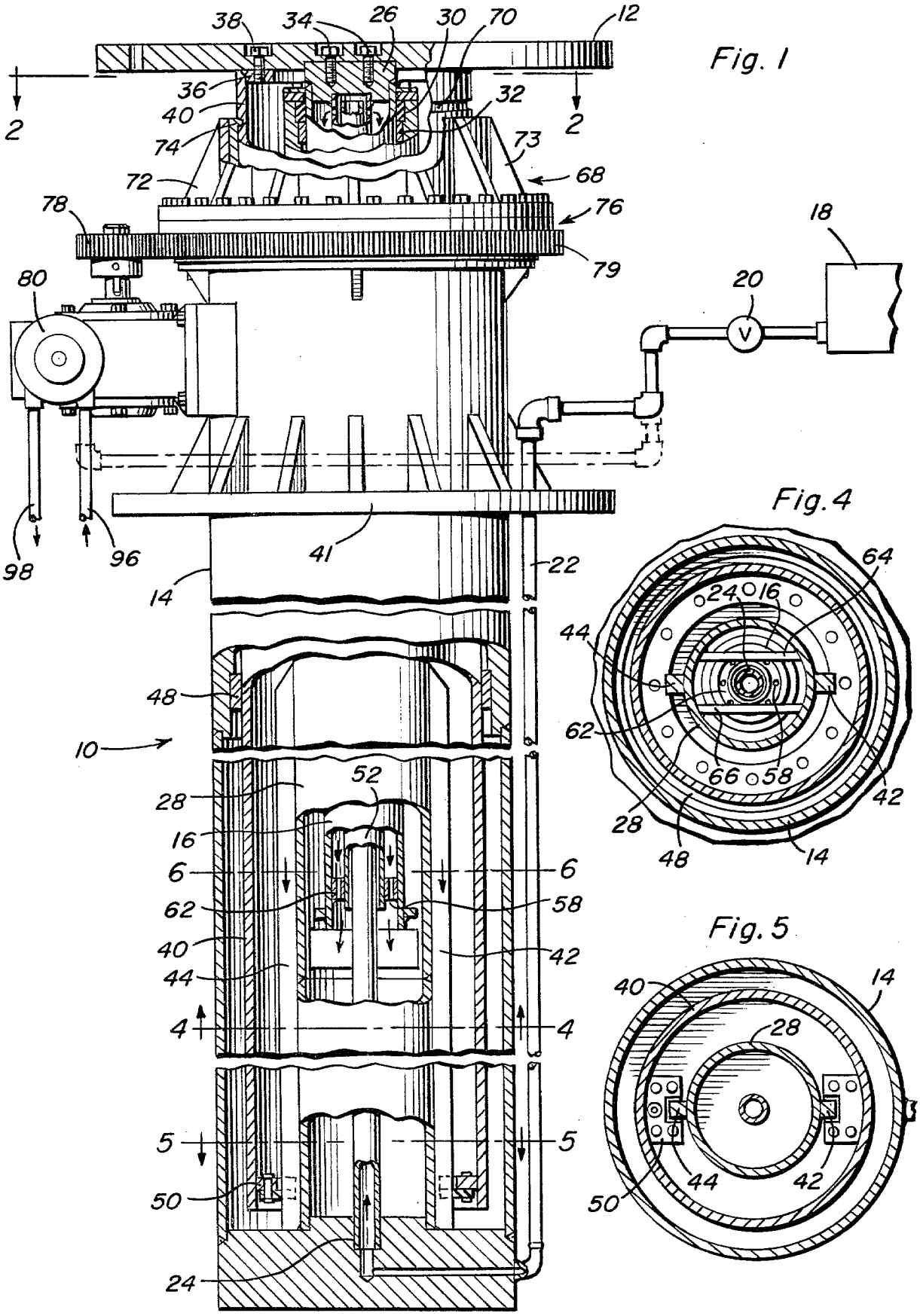
FIG. 1 is a side elevational view of the hydraulic cylinder of the present invention including a cutout portion in section illustrating the hydraulic fluid delivery system for the power lifting ram.
FIG. 4 is a transverse sectional view taken generally along the line 4—4 of FIG. 1 and illustrating the bottom of the hydraulic operated ram.
FIG. 5 is a transverse sectional view taken generally along the line 5—5 of FIG. 1 and illustrating the guide mechanism for controlling the rotational movement of the guide cylinder.
Figure 3:
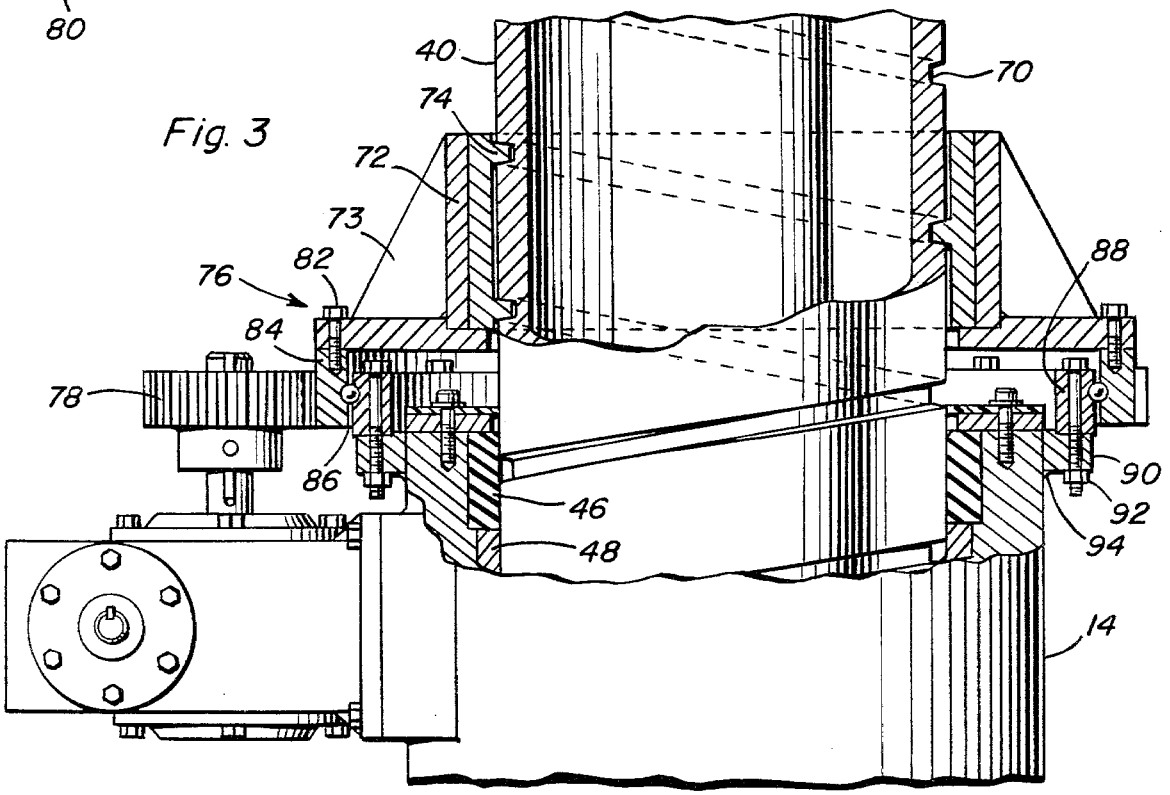
FIG. 3 is an enlarged side elevational view, partially broken away in section, illustrating the attachment of the rotating locking nut and rotating bearing assembly on the guide cylinder casing and further illustrating the matching relationship between the threaded locking nut and the exterior of the guide cylinder.

Referring to FIGS. 1 and 3, there is illustrated hydraulic cylinder 10 having secured thereon load platform 12 which is capable of supporting and raising a heavy load to the desired height. Hydraulic cylinder 10 includes exterior casing 14 in which slides cylindrical ram 16 operated by hydraulic fluid pumped from supply 18 through valve 20 at the proper operating volume and pressure to piping system 22 to oil passage tube 24 and into pressurized contact with fluid reacting plate 26 at the end of ram 16. The fluid pressure on fluid reactive plate 26 raises the load to the predetermined height, valve 20 providing the controlled hydraulic fluid pressure and volume. Ram 16 is enclosed within cylindrical casing 28. A guide bearing 32 with seals 30 are placed within a heavy wall area at the top of casing 28 to provide the proper sliding movement and sealing means for ram 16 within. Fluid reactive plate 26 is recessed into load platform 12 which is bolted to plate 26 by means of bolts 34. Load platform 12 is also secured to a welded flange 36 by means of bolt 38, flange 36 being welded to guide cylinder 40 which is concentric about and encloses ram casing 28 and ram 16. Ram 16 and guide cylinder 40 move in unison as hydraulic fluid is supplied to fluid reactive plate 26. Shown also in FIG. 1 is utility platform 41, affixed to the exterior of casing 14.

Secured to the exterior of casing 28 is a guide system, shown in FIG. 1 as a non-rotating guide arrangement comprising guide bars 42 and 44 which extend to the bottom of casing 28. Guide cylinder 40 is guided within bearings 48 which are mounted in a heavy wall section of casing 14 and spaced suitably to provide the required stability. A seal mechanism 46 prevents dirt or debris from getting into the guide cylinder 40. Additionally, the interior of guide cylinder 40 is provided with guide shoes 50 placed at the bottom of guide cylinder 40 and which follow the path of guide bars 42 and 44 to provide a straight line vertical movement to guide cylinder 40 or permit a circular movement depending upon the configuration of the guide bars. Alternatively, guide bars 42 and 44 may be attached to the inside surface of exterior casing 14 and guide shoe 50 placed on the exterior of guide cylinder 40 to provide a similar effect. The guide arrangement for controlling movement of guide cylinder 40 is further shown in FIG. 5 in which guide shoes 50 encloses guide bars 42 and 44, to prevent rotational movement of guide cylinder 40 as it is being raised and lowered.

Figure 6:
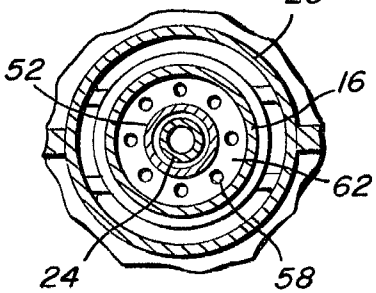
FIG. 6 is a transverse sectional view taken generally along the line 6—6 of FIG. 1 and illustrating the concentric construction of the hydraulic fluid delivery system for the power lifting ram.

Inner oil passage tube 24 extends to the top of ram 16 and ram casing 28, the pressurized fluid being directed against reactive plate 26. Guide tube 52 fixed at the top and bottom of ram 16 encloses fluid passage tube 24 and has incorporated therein orifices 54 and 56 for the purpose of automatically exhausting entrapped air accumulated at the top of ram 16, the air following the path of oil from the interior of ram 16 during the lowering or return stroke, the flow of oil being shown by the arrows incorporated into the drawings. Oil and air can be removed from between the outer casing of ram 16 and guide tube 52 through orifices 58 placed in concentric plate 62 welded to the interior of ram 16. Ram 16 is stopped from lowering beyond the top of guide cylinder 40 by internal stops 64 and 66 welded to casing 28 as shown in FIG. 4. The concentric arrangement of hydraulic fluid passage tube 24, plate 62, guide tube 52, ram 16 and casing 28 is shown in FIG. 6. As described above, the arrangement of guide cylinder 40 around ram 16 for supporting load platform 12 permits the amount of hydraulic fluid required to raise the load to be minimized in volume at the same time elevated in pressure. Also, enclosed ram 16 is not exposed to extreme environmental conditions which could damage the ram structure, impair the efficient operation of the hydraulic cylinder, and produce a significant safety hazard during operation.

Attached to hydraulic cylinder 10 is a unique safety attachment which will prevent the hydraulic cylinder and its load from lowering in the event of a sudden loss in hydraulic pressure. Referring to FIG. 1, there is illustrated the safety attachment generally indicated by reference numeral 68. Safety attachment 68 includes a helical groove 70 placed along the exterior surface of guide cylinder 40. Groove 70 formed in guide cylinder 40 extends along a predetermined length of guide cylinder 40, depending upon the desired height load platform 12 is to be raised. A heavy flanged locking nut 72 includes a thread 74 which is matched with groove 70. Gussets or flanges 73 provide increased strength for locking nut 72. Locking nut 72 is mounted for rotation on a heavy-duty anti-friction rotating bearing assembly 76. Locking nut 72 is capable of being rotated and moved relative from one end of guide cylinder 40 to a distance corresponding to the required travel of hydraulic cylinder 10 or the length of groove 70. Rotating bearing assembly 76 includes on the outside thereof a machined gear surface 79 which surface is intermeshed with the gear teeth of drive gear 78. Locking nut 72 can rotate in either direction based upon the direction of rotation of drive gear 78 which in turn is rotated by motor 80, preferably a hydraulically operated motor.

Figure 2:
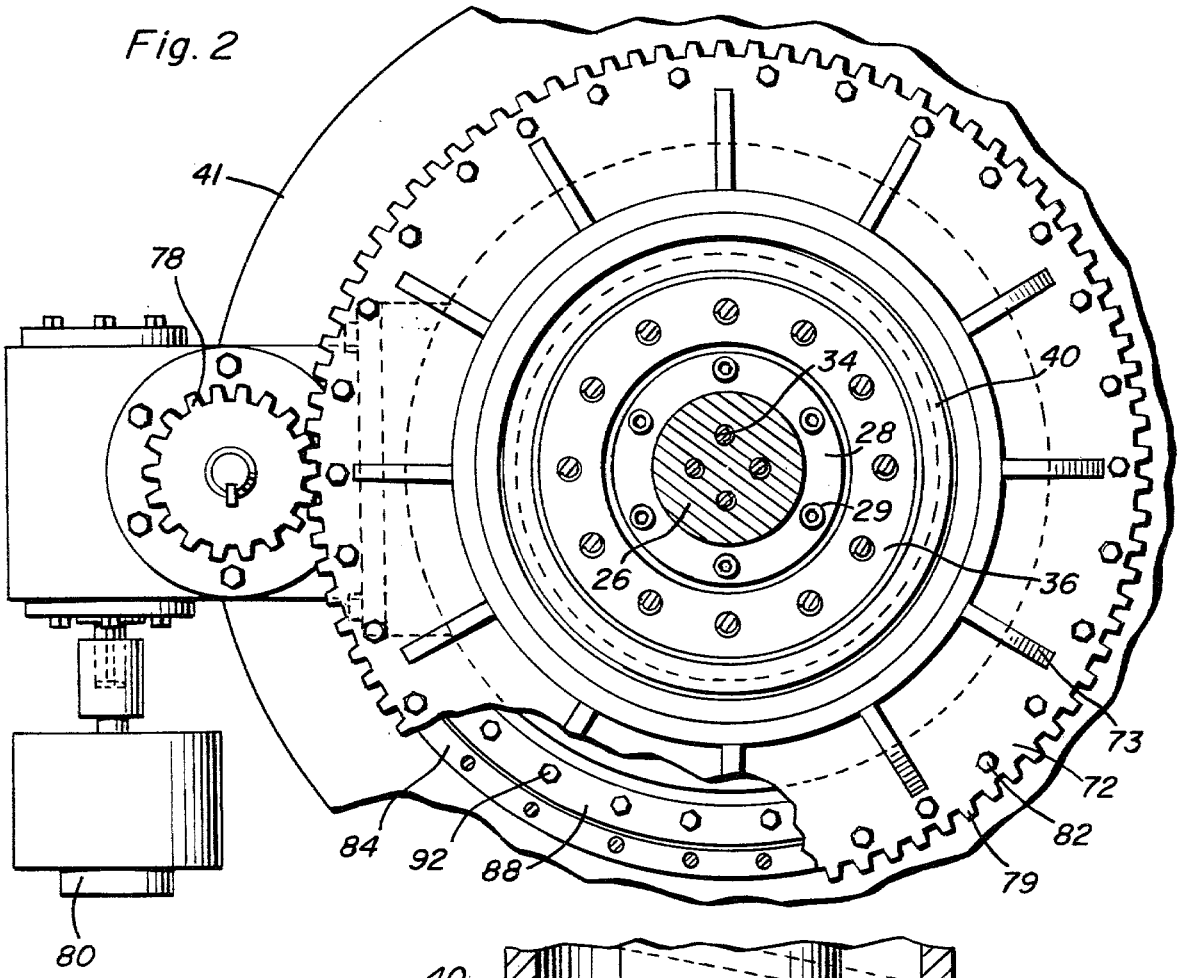
FIG. 2 is transverse sectional view of the hydraulic cylinder of the present invention taken generally along line 2—2 of FIG. 1 and illustrating the arrangement of the rotating bearing assembly, the drive gear with attached motor and the concentric arrangement of internal components.

Referring specifically to FIGS. 2 and 3, wherein safety attachment 68 is illustrated in greater detail, helical groove 70 is cut within the exterior surface of guide cylinder 40 and extends along a predetermined length thereof. Locking nut 72 is mounted for rotation on rotating bearing assembly 76 by means of a series of bolts 82 placed in outer rotating ring 84 of bearing assembly 76. Rotating ring 84 slides over a series of bearings 86 placed along the outer circumference of inner surface 88 of rotating bearing assembly 76. Inner surface 88 of rotating bearing assembly 76 is rigidly attached to flange 90 by means of bolts 92, flange 90 being welded to exterior casing 14 by weldment 94.

Rotation of ring 84 and attached locking nut 72 is accomplished by rotation of drive gear 78 which in turn is rotated by motor 80. Locking nut 72 can be prevented from rotating by controlling the operation of motor 80 as can be clearly determined.

The helix angle of helical groove 70 along the exterior surface of guide cylinder 40 is preferably less than 10° in order that the tangential force developed by a load suddenly deposited on the locking nut is less than the friction between thread 74 of locking nut 72 and the internal surfaces of groove 70. Accordingly, the tangential and frictional forces between locking nut 72 and the exterior surface of guide cylinder 40 will change depending upon the helix angle.

Due to the construction of bearing assembly 76, a considerable amount of upward and/or downward force is absorbed by the bearing housing. Matching thread 74 of locking nut 72 is constructed in relation to groove 70 on guide cylinder 40 so that there is ample capacity to withstand the various loads involved, all within a factor of safety consistent with the loads being handled. Accordingly, threads 74 may be constructed of a material of higher strength than the other portions of locking nut 72.

Ram 16 and guide cylinder 40 can only be raised and lowered by the rotation of locking nut 72. As guide cylinder 40 is being raised, motor 80, illustrated in FIG. 1 as a hydraulic motor, rotates drive gear 78 which in turn rotates ring 84 and the attached locking nut 72. Rotation of bearing assembly 76 and attached locking nut 72 is accomplished in such a way so as to be in alignment with and coordinated with the movement of helical groove 70 on guide cylinder 40. To provide upward and downward movement of guide cylinder 40, the potential travel speed of locking nut 72 is slightly in excess of that required to match the vertical speed of guide cylinder 40. Preferably, threads 74 are constantly in contact with groove 70. The power of hydraulic motor 80 is limited so that locking nut 72 will be in constant contact with and in a supportive position along guide cylinder 40 without actually providing enough power to raise the load. Accordingly, single thread 74 acts as a support to prevent guide cylinder 40 and ram 16 from falling with its load in the event of a sudden loss in hydraulic pressure. Safety attachment 68 operates in a similar fashion when the load is being lowered with locking nut 72 being forced ahead of helical groove 70 on guide cylinder 40 at all times. This prevents the load from locking up. As illustrated in FIG. 1, hydraulic motor 80 can be operated by the introduction of hydraulic fluid in inlet 96, the hydraulic fluid circulated through motor 80 and leaving through outlet 98. As shown in phantom, hydraulic fluid to operate motor 80 can also be supplied through valve 20, the operation of motor 80 and ram 16 being accomplished through substantially the same valving system.

Figure 7:
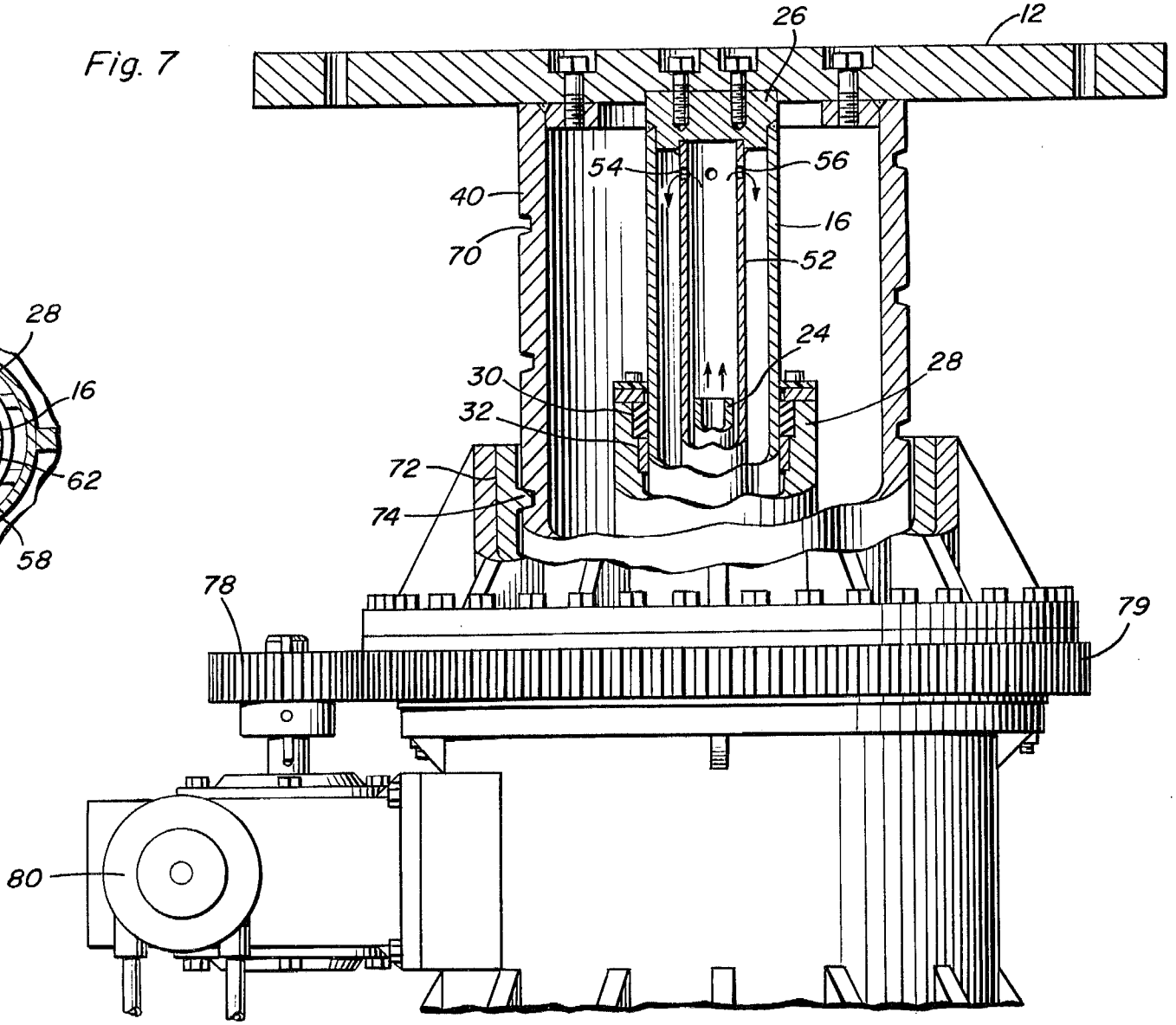
FIG. 7 is an enlarged side elevational view cut out in section illustrating the hydraulic operated ram and guide cylinder in raised position.

As can be seen, safety attachment 68 provides a unique method of locking a hydraulic cylinder in any position and can lock the cylinder in position within tolerances normally associated with gear driven devices. Safety attachment 68 illustrated in the drawings can be expected to maintain a vertical height within 1/16 of an inch when ram 16 is being lowered and within a few thousandth of an inch when ram 16 is being raised. Tolerances even closer than these limits may be obtainable when required. FIG. 7 illustrates the relative position of guide cylinder 40 with respect to locking nut 72 during the lifting stroke of ram 16.

Referring again to FIG. 2, the concentric arrangement of the internal components of hydraulic cylinder 10 are clearly shown. In the center, is shown fluid reactive plate 26 of cylindrical ram 16 including bolts 34. Placed directly around ram 16 is casing 28 containing bolts 29, placed to secure seals 30, also shown in FIG. 7. Enclosing casing 28 and ram 16 is guide cylinder 40 containing a plurality of bolts 38 to support load platform 12 thereon. Placed in contact with guide cylinder 40 is locking nut 72 secured to outer rotating ring 84 by means of bolts 82, the inner surface 88 of rotating bearing assembly being secured by means of bolts 92.

While the operation of safety attachment 68 has been described as the rotation of locking nut 72 containing a helical thread, it is possible to provide a rotating motion to guide cylinder 40 and ram 16 during the raising stroke and utilize a locking nut containing a straight key rather than helical thread 74. Rotation of cylinder 40 can be accomplished as described above by the appropriately shaped guide bars.

The system for controlling the amounts of hydraulic fluid supplied to hydraulic cylinder 10 and motor 80 should be one that can simultaneously control the rotational movement of locking nut 72 and the lifting of the load by ram 16 and guide cylinder 40.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A hydraulic cylinder comprising a hydraulically operated ram for lifting an attached load and a safety locking means secured to said cylinder, said safety locking means capable of supporting said load at all positions during the lifting and return stroke of said ram, said hydraulically operated ram being secured to a load support means, said load support means being capable of supporting a load thereto, said hydraulical cylinder further includes a guide cylinder placed around and enclosing said ram, said guide cylinder being secured to said load support means, said ram and said guide cylinder capable of moving in unison to support said load, said ram being protected from the environment surrounding said cylinder by being totally enclosed by said guide cylinder, said safety locking means being in contact with said guide cylinder, said guide cylinder containing a groove along the exterior surface thereof, said groove extending along said exterior surface for a predetermined length over said surface, said safety locking means including a thread to match said groove, said thread being in contact with said groove substantially at all times during the movement of said guide cylinder, said safety locking means comprising a threaded nut rotatable about the exterior surface of said guide cylinder wherein rotation of said safety locking means enables the movement of said guide cylinder, said groove being a single helical groove and said thread being a matching helical thread, said safety locking means being affixed at a permanent position on said hydraulic cylinder, said guide cylinder and said ram being movable relative to said safety locking means, and an exterior outer casing surrounding said guide cylinder, said safety locking means being attached for rotation to a rotating bearing assembly attached to said exterior casing.

2. The hydraulic cylinder of claim 1 wherein said bearing assembly includes a rotatable ring concentric about said guide cylinder, said threaded nut being attached to said rotating ring, said bearing assembly including an inner support flange secured to said outer casing, said rotating ring being movable past a plurality of bearings positioned between said rotating ring and said inner support flange.

3. The hydraulic cylinder of claim 2 wherein said rotating ring includes a plurality of gear teeth placed on the outside thereof, said gear teeth being intermeshed with a rotatable drive gear for rotating said ring and said attached safety locking means.

4. The hydraulic cylinder of claim 3 wherein said hydraulic cylinder further includes a motor for rotating said drive gear.

5. The hydraulic cylinder of claim 4 wherein said motor is hydraulically operated.

6. The hydraulic cylinder of claim 5 further including guide means capable of controlling the rotational movement of said guide cylinder.

7. The hydraulic cylinder of claim 6 wherein said guide means includes a shoe secured to said guide cylinder and a guide bar positioned along the vertical extent of said guide cylinder, said guide shoe capable of following the position of said guide bar during the movement of said guide cylinder.

8. The hydraulic cylinder of claim 7 further including a casing surrounding said ram, said casing being placed between said ram and said guide cylinder, said guide bar being placed along the exterior surface of said casing, and said guide shoe being placed along the interior surface of said guide cylinder.

9. The hydraulic cylinder of claim 8 wherein said ram is a cylinder containing a fluid reactive plate placed at one end of said cylinder, said plate being attached to said load platform, said cylinder including delivery means by which hydraulic fluid is passed through said cylinder and in contact with said fluid reactive plate to provide movement of said ram.

10. The hydraulic cylinder of claim 9 wherein said delivery means includes a tube for holding the hydraulic fluid, said tube extending into said ram, said tube being surrounded by an inner cylinder having a length substantially equal to the length of said ram, said inner cylinder being secured to said fluid reactive plate at one end of said ram and to the cylindrical surface of said ram at the opposite end thereof, said inner cylinder including a series of orifices placed near the end closest to said fluid reactive plate for removing air from between said delivery tube and said reactive plate.

11. A hydraulic cylinder including an outer tubular cylinder portion having first and second ends and stationarily supported at said first end, a tubular piston portion having first and second ends and having its first end slidingly telescopingly engaged in said second end of said cylinder portion, said second end of said cylinder portion including seal and bearing means slidingly and sealingly engaged with the outer surface of said piston portion, means for admitting and exhausting fluid under pressure into and from the interior of said cylinder portion, a first stationary outer tubular casing having first and second ends, said first end of said outer casing being stationarily supported relative to said cylinder portion first end and loosely enclosing said cylinder portion therein, a second inner casing including first and second ends and having its first end loosely telescoped into said outer tubular casing through the second end thereof and loosely telescoped over said outer cylinder portion, said second end of said outer tubular casing including seal and bearing means slidingly and sealingly engaged with the outer surface of said inner casing, a load platform to which said first ends of said piston portion and second inner casing are secured, whereby said tubular piston portion and said inner casing are interconnected for equal and simultaneous extension and retraction relative to said tubular cylinder portion and said first outer tubular casing, said outer tubular cylinder portion being loosely received in said inner casing first end, said second end of said inner casing including low lead external thread means thereon, a safety nut journaled from said second end of said outer tubular casing and provided with low lead internal threads threaded on said thread means, and means for selectively driving said nut in opposite directions.

12. The cylinder of claim 11 wherein said inner tubular piston portion includes an inner guide tube loosely received therein and having first and second ends with the second end thereof anchored relative to the second end of said inner tubular piston portion and its first end projecting toward and stationarily anchored in said first end of said tubular piston portion, and an oil passage tube having first and second ends, said first end of said oil passage tube being stationarily anchored relative to the first end of said outer tubular cylinder portion, the second end of said oil passage tube being loosely telescopingly received in the first end of said inner guide tube, the second end of said inner guide tube having lateral fluid passage ports formed therethrough communicating the interior of said second end of said guide tube with the interior of the second end of said tubular piston portion.

13. The cylinder of claim 11 wherein the first end of said inner casing and said outer cylinder portion include coacting guide means guiding the first end of said inner casing relative to said outer cylinder portion.

* * * * *